United States Patent [19]

Chalker

[11] 4,114,277

[45] Sep. 19, 1978

[54] METHOD OF FITTING A GARMENT

[76] Inventor: Betty B. Chalker, 3650 Sulene Dr., College Park, Ga. 30349

[21] Appl. No.: 713,677

[22] Filed: Aug. 12, 1976

[51] Int. Cl.[2] ..... A41H 3/00
[52] U.S. Cl. ..... 33/14; 33/17 R
[58] Field of Search ..... 33/17 R, 14, 15, 16, 33/11, 12, 13

[56] References Cited

U.S. PATENT DOCUMENTS

| | | | |
|---|---|---|---|
| 1,175,996 | 3/1916 | Rothenberger | 33/14 |
| 1,416,383 | 5/1922 | Rose | 33/12 |
| 2,531,781 | 11/1950 | Mongelli | 33/14 |
| 3,964,169 | 6/1976 | Bush | 33/15 |

OTHER PUBLICATIONS

"Pattern Alteration" - Farmers' Bulletin, No. 1958- p. 14 - FIGURE 6.

*Primary Examiner*—Richard E. Aegerter
*Attorney, Agent, or Firm*—James B. Middleton

[57] ABSTRACT

The method of fitting a garment on a particular person by adjusting the placement of the garment on the person to locate the portion of the garment having the maximum perimeter substantially over the portion of the person having the maximum perimeter. For fitting a pair of pants on a person, a pattern inset is provided wherein the crotch of the pants is adjusted to provide a seat curve and to locate the maximum hip perimeter of the pants over the maximum hip perimeter of the person.

2 Claims, 6 Drawing Figures

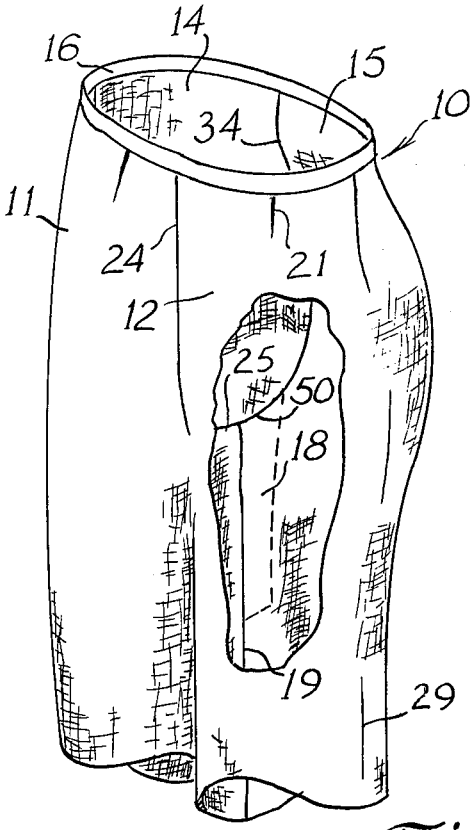
Fig. 1
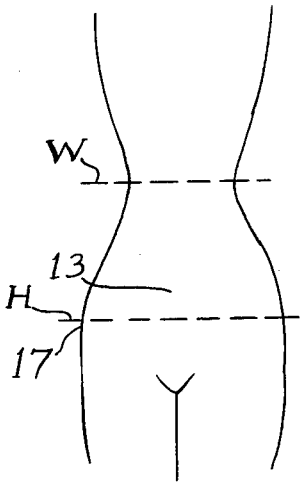
Fig. 2
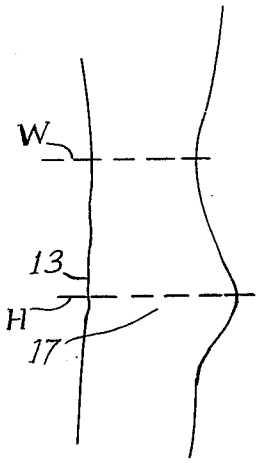
Fig. 3
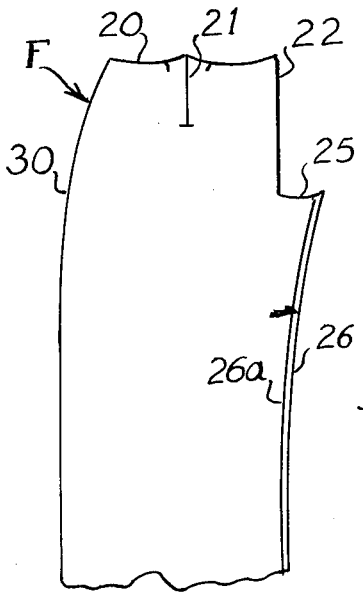
Fig. 4
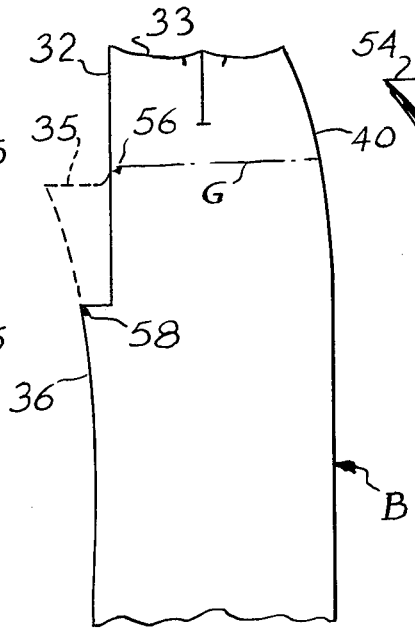
Fig. 6
Fig. 5
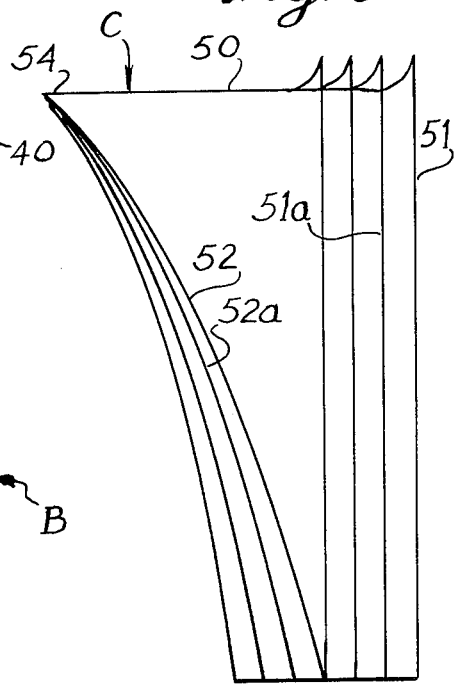

METHOD OF FITTING A GARMENT

This invention relates to garmet fitting means, and is more particularly concerned with a garment pattern having a variable insert means for locating the garment on a person to make the garment fit a particular individual.

It is well known that commercially available patterns are designed to fit an "average" person, and that a garment made strictly according to the pattern will rarely fit the actual person for whom the garment is made. The usual printed pattern has various guides and suggestions for altering a pattern to accommodate individual variations, but such alterations tend not to effect a good fit for the garment.

While the terms "size" and "fit" may be somewhat synonymous, the term "size" will herein be used to indicate simply gross dimensions of a garment without regard to the contours of a body and whether or not the garment follows those contours. The term "fit", on the other hand, will be used to indicate that quality of a garment to conform to individual body contours so that the fabric will lie smoothly over the body without wrinkling, sagging, stretching or the like. It will thus be understood that a garment with proper fit not only will be of such sizes as to allow a person to wear the garment, but also will be proportioned that the fabric lies smoothly and naturally over the body of the wearer.

With the above definitions in mind, it will be understood that the usual means for altering a pattern provides for changes in size so that portions of a garment can be lengthened or shortened, but conventional patterns do not provide for proper "fit" of a garment. A garment must therefore be made up and tried, on either the person for whom the garment is being made or a custom-made dummy. The garment can then be altered, largely by trial and error, to attain the desired fit. It will of course be understood that a person sewing for himself will find it very difficult to alter a garment while wearing the garment because one must bend and stoop to pin the garment in place, but one must adjust the garment while standing generally erect. Though a dummy can frequently be used, the dummy must be custom-formed to allow the desired fit, and such dummies are quite expensive.

The present invention overcomes the above mentioned and other difficulties with the prior art fitting of a garment made from a pattern by providing an inset as a part of the pattern, the inset being variable in accordance with proportions of the body to be fit so that the pattern in conjunction with the appropriate variation of the inset will produce a garment so contoured and so located on a person as to fit properly. In more detail, the present invention includes a crotch inset for a pair of pants, the configuration of the crotch inset being determined as a function of the distance from the waist to the maximum hip dimension. Further, it has been discovered that there is an empirical relationship between such distance, hereinafter referred to as the "hip length", the hip measurement, and the size of the crotch inset. Through use of the present invention, therefore, it will be understood that a pattern would be printed to include an inset for adjusting the garment for proper fit. Since a person simply takes a measurement of the body to be fitted, and selects the variation of the inset commensurate with the measurement, it will be seen that a person can make a garment fit oneself as well as another. The system of the present invention is relatively simply yet effective, and provides a good fit for a garment.

These and other features and advantages of the present invention will become apparent from consideration of the following specification when taken in conjunction with the accompanying drawings in which:

FIG. 1 is a perspective view, partially broken away showing a pair of pants having a crotch inset to provide proper fit for the garment in accordance with the present invention.

FIGS. 2 and 3 are schematic diagrams indicating the measurements necessary for utilizing the system of the present invention;

FIG. 4 is a partial plan view of a pattern piece for the pants shown in FIG. 1 of the drawings;

FIG. 5 is an enlarged plan view of a crotch inset designed in accordance with the present invention for use in fitting a garment such as that shown in FIG. 1; and, FIG. 6 is a pattern piece for the pants as shown in FIG. 1, and illustrating the location for the crotch inset of the present invention.

Referring now more particularly to the drawings and to that embodiment of the invention here chosen by way of illustration, it will be seen that the garment 10 shown in FIG. 1 of the drawings is made up primarily of four pieces 11, 12, 14 and 15. The pieces 11 and 12 are two front pieces, cut by the same pattern piece but cut to be mirror images of each other. Similarly, the pieces 14 and 15 are two back pieces that are mirror images of each other. The pants 10 are completed by a waist band 16 or other finishing means as desired, and the pants may include other trim and decorative features as desired.

It will be seen in FIG. 1 that the crotch inset is indicated at 18, and is bounded by the in-seam 19 along one edge, and is outlined by a broken line on the opposite edge. As will be seen more clearly hereinafter, the crotch inset 18 is not sewn into the garment as a separate pattern piece; rather, the crotch inset 18 is used as a pattern adjustment prior to cutting the back pattern pieces 14 and 15.

Looking primarily at FIGS. 4–6 for a better understanding of the system involved in the present invention, it will be seen that the FIG. 4 shows a pattern for the front of the pants 10, to cut the pieces 11 and 12. For convenience, the pattern piece shown in FIG. 4 will be referred to as piece F. Thus, the upper edge 20 of piece F would be the upper edge of the pants 10, the edge where the waist band 16 would be connected. A dart 21 is marked on the piece F as is conventional and will be understood by those skilled in the art.

The right-hand edge of the piece F, as shown in the drawing, has a straight section 22 which will be in the front seam 24 of the pants 10, and it is important to note that this section 22 is straight and parallel to the warp yarns of the fabric. At the lower extremity of the section 22, the edge curves outwardly at 25 to provide the front crotch section. Then, at the extending end of the front crotch section 25, the edge extends down, curving into the leg section and providing the section 26. The section 26 therefore will become part of the in-seam 19 of the pants 10.

Since the right-hand edge of the piece F forms the front seam 24 and in-seam 19, it will be understood that the left-hand edge of the piece F will form a part of the out-seam 29. The front out-seam section 30 thus begins at upper edge 20 and curves out and down to merge with the leg portion of the piece F.

From FIGS. 2 and 3 it will be seen that the area 13 of the body that receives the front seam 24 is relatively flat, while the portion 17 of the body that receives the out-seam 21 is significantly curved. Thus, in order to achieve the best results, it has been found that the section 22 of the piece F should be straight, and the curved lines to achieve the fit around the curves of the body are achieved by the dart 21 and the curved front out-seam section 30.

Turning now to FIG. 6 of the drawings, the pattern piece there shown is designated piece B and constitutes the pattern piece for cutting the pieces 14 and 15 of the pants 10. The drawings are oriented so that the crotch sections are adjacent to each other to facilitate an understanding of the crotch inset of the present invention. The back crotch section 35 is shown in FIG. 6 in broken lines because the crotch section 35 is omitted on the pattern piece B and is to be supplied by means of the crotch inset shown in FIG. 5 of the drawings. However, it will be seen that the crotch section 35 would merge into a straight line 32 which would be parallel to the warp yarn of the fabric. The section 32 then extends up to the upper edge 33 of the piece B.

It is important to note that, though the crotch inset is shown as a separate pattern piece, the crotch inset would not be a separate piece of fabric in the construction of the garment, as will appear hereinafter. The crotch inset could properly be characterised as a pattern extension in that the crotch inset is simply added to the pattern piece for the back of the pants to cut a single piece of fabric to be used in construction of the garment. Thus, while it has been known to inset a separate crotch piece in the construction of a garment, primarily to save fabric, the present invention utilizes a crotch inset for the pattern but contemplates a single piece of fabric.

It will be remembered that the section 22 of the piece F is a straight line because the area 13 of the body to receive this part of the pattern (i.e. the lower abdomen) is relatively flat. The reason for the straight line in the section 32 of the piece B is comparable. While the sacral region of the body is not flat in the sense of planar, a line across the sacral area would be a relatively straight line. As a result, the sacral area of the body can be thought of as approximating a cylindrical shape so that the section 32 will be a circumferential line on the wall of the cylinder, thereby providing an accurately placed garment part that will easily conform to the portion of the body on which it lies.

The section 36 of the piece B extends from the crotch section 35 and provides part of the pants in-seam 19, to mate with the section 26 of Piece F and be sewn thereto.

The right-hand edge 40 of the piece B as shown in FIG. 6 curves out and down from the top edge 33 in a shape commensurate with the edge 30 of piece F. It will be understood that the edge 40 of piece B will be sewn to the edge 30 of piece F in construction of the garment to make up the out-seam 29 of the pants 10.

From the foregoing discussion it will be understood that one piece F and one piece B will be sewn together to form half the garment 10 shown in FIG. 1 of the drawings; and, the front seam 24 is constructed to lie flat on the relatively flat portion 13 of a person's anatomy while the back seam 34 will be curved in a transverse plane but will lie smoothly along the backbone. Then, for the portions of the anatomy that are curved, the pieces F and B are curved. Specifically, the crotch area of the person is fit by the mating crotch pieces 25 and 35.

It will be seen that, if the garment fails to fit properly, the seam in the crotch area could be lengthened or shortened, thereby allowing the back seam 34 to curve out (i.e. rearwardly) more or less while maintaining the same shape. However, in the event the person's lower abdomen is not quite flat, it will be understood that a change in the length of the same seam would allow the front seam 24 to curve in the plane as illustrated in FIG. 3 without causing distortion in other directions.

Attention is next directed to FIG. 5 of the drawings for a showing of the means for varying the crotch seam as described above. It should be understood that the piece shown in FIG. 5 indicated as C would provide the crotch section 35 shown in broken lines in FIG. 6 of the drawings. The piece C is therefore a crotch inset having a variable size and shape to adjust the crotch seam to the desired length and thereby provide the necessary configuration of the garment. As was mentioned briefly hereinabove, it has been found that the change in the crotch seam necessary to yield proper fit is a function of the hip length.

FIGS. 2 and 3 illustrate the hip length in some detail. It will there be seen that one first finds the waist indicated by the broken line W. Next, one locates the part of the hips having the greatest perimeter. This hip line is designated by the broken line H, and it should be noted that the hip line H must always be above the stride line. If one measures below the stride line, there will be two leg to be measured rather than the single body and spurious results are obtained. For convenience of illustration, a somewhat idealized figure is used and the maximum hip perimeter is clearly above the stride line. Having found the waist W and the hip line H, one then measures perpendicularly between these two lines to obtain the hip length. The hip length therefore indicates the necessary location of the maximum perimeter of the garment; and, by adjusting the crotch seam in accordance with this hip length the maximum perimeter of the garment is in fact placed over the portion of the hips having the greatest perimeter.

Though there may be some theoretical means for determining the adjustment to be made in the crotch seam, it has been found that there is a relationship between the hip perimeter and the adjustment. Specifically, if one measure one-half the back, at the hip line H, 40% of this measurement is the required crotch adjustment. The measurement is made on the person, rather than on the pattern, but for purposes of illustration the line G in FIG. 6 shows what measurement is to be taken. Thus, the measurement would be from the place on a person where the side seam 29 would be located, around the back to the point where the back seam 34 would be located. Such a measurement can be called a half back since it amounts to half the distance required for the back of the garment. Forty per cent of this half back, or length G, gives the proper crotch adjustment.

The piece C shown in FIG. 5 of the drawings is laid out by assuming a length G, taking 40% of that length, and using the result as the upper line 50 of the piece C. In practice, one will start with the maximum reasonably possible length G for a given size of pattern, then use increments decending from the maximum down to the minimum reasonably possible length G. So, one might have, as the first length of the half back 20 cm. Forty percent of this equals 8 cm, so the line 50 would be 8 cm. long. The right-hand side 51 would simply be straight, parallel to the wrap yarn of the fabric. The left-hand side 52 curves from the outermost point 54 of the top 50 to merge into the leg portion of the pattern piece B shown in FIG. 6.

The next length G may be, e.g., 18 cm. giving a top 50 length of 7.2 cm. Thus, a line 51*a* is drawn parallel to the line 51, the line 51*a* being 7.2 cm. from the point 54 of the top line 50. Since the piece C will be moved over with respect to the piece B, a new line 52*a* will be drawn from the point 54 to merge with the leg portion. This procedure will be followed for a sufficient number of increments to include the full range of individuals a given pattern can reasonably fit.

After the foregoing discussion of the lay-out of a pattern in accordance with the present invention, the construction of a garment in accordance with the present invention should be understood.

First, it will be understood by those skilled in the art that one will select a pattern of the approppriate size. In the case of a pants pattern, the size will generally be the hip measurement of the person to be fitted.

Next, the piece C must be appropriately placed with respect to the piece B. To achieve this, one must find the maximum hip measurement to define the hip line H, then locate the waist W, and measure between these two to determine the hip length. If the hip length is 18 cm., e.g., the line 51*a* will be placed in alignment with the edge 32 of the piece B with the upper end of the line 51*a* adjacent to the mark 56. The piece C, when so located, should be taped or otherwise fixed into place so that resulting pattern piece can be placed on fabric for cutting out the garment pieces.

Since the adjustment made in the pattern is made in the crotch of the pants, it will be understood that an adjustment to either extreme may shift the in-seam to an undesirable extend. To correct for this undesirable shifting, the piece F shown in FIG. 4 may include a portion of the correction. Thus, only two lines may be provided for the section 26, a second line 26*a* being here shown. The line 26 would be used for the larger half of the hip lengths, and the line 26*a* would be used for the smaller half of the hip lengths. This technique maintains the in-seam 19 within a desirable location.

It will be understood by those skilled in the art that each of the pieces of the particular pattern will be cut from fabric in accordance with the usual instructions on the pattern. When all pieces have been cut, the garment can be assembled.

In assembling the garment of the present invention, one would first take one piece F and on piece B, the piece B having the piece C included therein, and the out-seam of these two pieces will be sewn together. The edge 30 of piece F and 40 of piece B will make up the out-seam 29, and the seam will be sewn in a conventional manner. The next two pieces F and B will be similarly sewn together so that the pieces 11 and 14 of pants 10 will be attached, and the pieces 12 and 15 will be attached.

After the out-seams are made, the in-seams should be sewn. To do this, the edges 26 and 36 of the joined pieces F and B will be put together from the hem line of the pants to the bottom point 58 of the inset. These edges will be the same length and can be stitched together conventionally. Once the pieces are sewn together to the point 58, one must stretch the two pieces F and B to force the line 52 or 52*a* to match the comparable section of the piece F. The inset acts as an extension on piece B so that piece B is forced out to form a seat curve. While the pieces are stretched to force them to match, the pieces are sewn together. One would then repeat the operation for the other in-seam.

Having the two legs of the pants made, each with its hip portion, one then turns one leg with the wrong side out, and places this leg within the other. In this condition the front seam 24, crotch seam, and back seam 34 can be sewn to complete the assembly of the basic four pieces of the pattern. It will be realized that the waist band 16 will be added; and, zippers, buttons, pockets, and other features would be included in the assembly or added later in accordance with usual techniques of assembly.

It will therefore be seen that the present invention provides a novel and effective means for adjusting a garment to achieve proper fit. The garment design can be varied considerably to suit individual tastes, styles, etc. without militating against the effectiveness of the garment fitting technique so that any style of garment can look its best on any individual.

It will of course be understood by those skilled in the art that the particular embodiment of the invention disclosed herein is by way of illustration only, and is meant to be in no way restrictive; therefore, numerous changes and modifications may be made, and the full use of equivalents resorted to without departing from the spirit or scope of the invention as defined by the appended claims.

I claim:

1. The method of fitting a garment to a particular person wherein said garment includes a contoured portion having a maximum perimeter and said person includes a contoured portion having a maximum perimeter substantially of such size as to receive said contoured portion of said garment, said garment being a pair of pants having a crotch seam, said method including the steps of defining a first reference line on said person at the waist of said person, defining a second reference line on said person at said maximum perimeter, said second reference line being generally on the hips of said person, determining the distance between said first reference line and said second reference line to determine the hip length, and selecting an inset for extending said crotch seam based on said hip length, the step of extending said crotch seam based on said hip length comprising the steps of providing an inset by measuring the length of half the back of said person at said second reference line, and making said inset with a crotch seam extension equal to 40% of said length of half the back.

2. The method as claimed in claim 1, said pants having an in-seam intersecting said crotch seam, the step of extending said crotch seam including the step of adjusting the width of material at said in-seam thereby to adjust the length of said crotch seam.

* * * * *